US011073262B2

(12) United States Patent
Robota et al.

(10) Patent No.: US 11,073,262 B2
(45) Date of Patent: Jul. 27, 2021

(54) LUMINAIRE WITH A RELEASABLY LOCKABLE WIRE COVER

(71) Applicant: SIGNIFY HOLDING B.V., Eindhoven (NL)

(72) Inventors: Andrew L. Robota, Senoia, GA (US); Rusty B. Flippo, Newnan, GA (US); Steven Russell Clements, Atlanta, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/417,401

(22) Filed: May 20, 2019

(65) Prior Publication Data

US 2020/0370732 A1 Nov. 26, 2020

(51) Int. Cl.

| | |
|---|---|
| ***F21V 17/16*** | (2006.01) |
| ***F21V 17/10*** | (2006.01) |
| ***F21S 8/00*** | (2006.01) |
| ***F21V 23/00*** | (2015.01) |
| ***F21V 19/00*** | (2006.01) |
| ***F21V 27/00*** | (2006.01) |
| *F21Y 115/10* | (2016.01) |
| *F21Y 103/10* | (2016.01) |

(52) U.S. Cl.

CPC ..... *F21V 17/164* (2013.01); *F21S 8/03* (2013.01); *F21V 17/107* (2013.01); *F21V 19/0045* (2013.01); *F21V 23/001* (2013.01); *F21V 23/009* (2013.01); *F21V 27/00* (2013.01); *F21Y 2103/10* (2016.08); *F21Y 2115/10* (2016.08)

(58) Field of Classification Search

CPC .. F21V 17/164; F21V 17/107; F21V 19/0045; F21V 23/001; F21V 27/00; F21S 8/03

See application file for complete search history.

(56) References Cited

U.S. PATENT DOCUMENTS

| | | | | |
|---|---|---|---|---|
| 4,952,157 | A * | 8/1990 | Hudson | F21V 21/03 439/334 |
| 6,780,049 | B1 * | 8/2004 | D'Angelo | F04D 29/601 439/313 |
| 9,322,533 | B1 * | 4/2016 | Pearson | F21S 8/036 |
| 9,595,794 | B2 * | 3/2017 | Birdwell | H01R 43/26 |
| 9,714,760 | B2 * | 7/2017 | Scoggin | F21V 23/06 |

(Continued)

FOREIGN PATENT DOCUMENTS

| | | | |
|---|---|---|---|
| CN | 109210436 | A | 1/2019 |
| EP | 3104069 | A1 | 12/2016 |
| JP | 2012064393 | A | 3/2012 |

*Primary Examiner* — Arman B Fallahkhair

(57) ABSTRACT

A luminaire includes a back plate and a wire cover. The back plate includes a first tab that defines a tab receiving cavity. Further, the first tab includes a first mating feature formed therein. The wire cover includes an inner surface that defines an electronics cavity, an outer surface that defines a light source mounting platform, and a second tab. The second tab includes a second mating feature that is complementary to the first mating feature. The second tab of the wire cover is disposed in the tab receiving cavity defined by the first tab of the back plate to removably couple the wire cover to the back plate. Further, the second mating feature of the second tab engages the first mating feature of the first tab to releasably lock the wire cover to the back plate.

18 Claims, 8 Drawing Sheets

(56) References Cited

U.S. PATENT DOCUMENTS

| | | | | |
|---|---|---|---|---|
| 10,641,291 | B2 * | 5/2020 | Jones | F04D 29/601 |
| 2011/0297971 | A1 | 12/2011 | Shimizu et al. | |
| 2014/0268747 | A1 * | 9/2014 | Demuynck | F21S 8/026<br>362/235 |
| 2017/0016584 | A1 * | 1/2017 | Snijkers | F21V 7/28 |
| 2019/0293273 | A1 * | 9/2019 | Brown | F21V 23/002 |
| 2020/0041103 | A1 * | 2/2020 | Germain | F21V 21/02 |
| 2020/0049326 | A1 | 2/2020 | Brown et al. | |

* cited by examiner

LUMINAIRE WITH A RELEASABLY LOCKABLE WIRE COVER

TECHNICAL FIELD

The present disclosure relates generally to lighting solutions, and more particularly to a luminaire with a releasably lockable wire cover.

BACKGROUND

Luminaires include wire covers that are configured to house and securely retain electronic components within the luminaires and/or to provide a concealed path for the electrical conductors (e.g., electrical wires) in the luminaire. Typically, the luminaires are shipped with the wire covers being removably coupled to the housing of the luminaires and/or with the electronic components disposed in electronics enclosures defined by the wire covers. However, the wire covers are formed using thin and/or flexible material. Consequently, vibrations and/or other impacts on the luminaire during shipping may cause the wire cover to flex and be decoupled (pop out) from the luminaire. Such a decoupling of the wire cover during shipping of the luminaire may cause damage to the luminaire and/or the electronic components that are securely retained by the wire cover.

The decoupling of the wire cover from the luminaire during shipping may be prevented by locking the wire cover to the luminaire using fasteners such as screws, for example. However, fastening the wire cover to the luminaire using screws may require the use of tools or other additional equipment for both installation and removal of the wire cover.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to a luminaire. The luminaire includes a back plate having a first tab that defines a tab receiving cavity. The first tab includes a first mating feature formed therein. Further, the luminaire includes a cover that is configured to securely house an electronic component within the luminaire. The cover includes a second tab having a second mating feature formed therein. The second mating feature is complementary to the first mating feature. The cover is coupled to the back plate by disposing the second tab of the cover in the tab receiving cavity defined by the first tab of the back plate such that the second mating feature engages the first mating feature to releasably lock the cover to the back plate.

In another aspect, the present disclosure relates to a luminaire. The luminaire includes a back plate having a first tab that defines a tab receiving cavity. The first tab includes a first mating feature formed therein. Further, the luminaire includes a wire cover that is configured to securely house an electronic component within the luminaire. The wire cover comprising a second tab having a second mating feature formed therein and coupling tabs that are configured to securely retain a light source on the cover. The second mating feature is complementary to the first mating feature. When the wire cover is coupled to the back plate, the second tab of the wire cover is disposed in the tab receiving cavity defined by the first tab of the back plate such that the second mating feature engages the first mating feature to releasably lock the wire cover to the back plate.

In yet another aspect, the present disclosure relates to a wire cover of a luminaire. The wire cover includes an inner surface that defines an electronics enclosure that is configured to securely house an electronic component within the luminaire. Further, the wire cover includes an outer surface that comprises coupling tabs that are configured to securely retain a light source on the cover. Furthermore, the wire cover includes a first tab having a first mating feature formed therein. The first mating feature is configured to engage a second mating feature of a second tab formed in the luminaire to releasably lock the wire cover to the luminaire. The first mating feature being complementary to the second mating feature.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
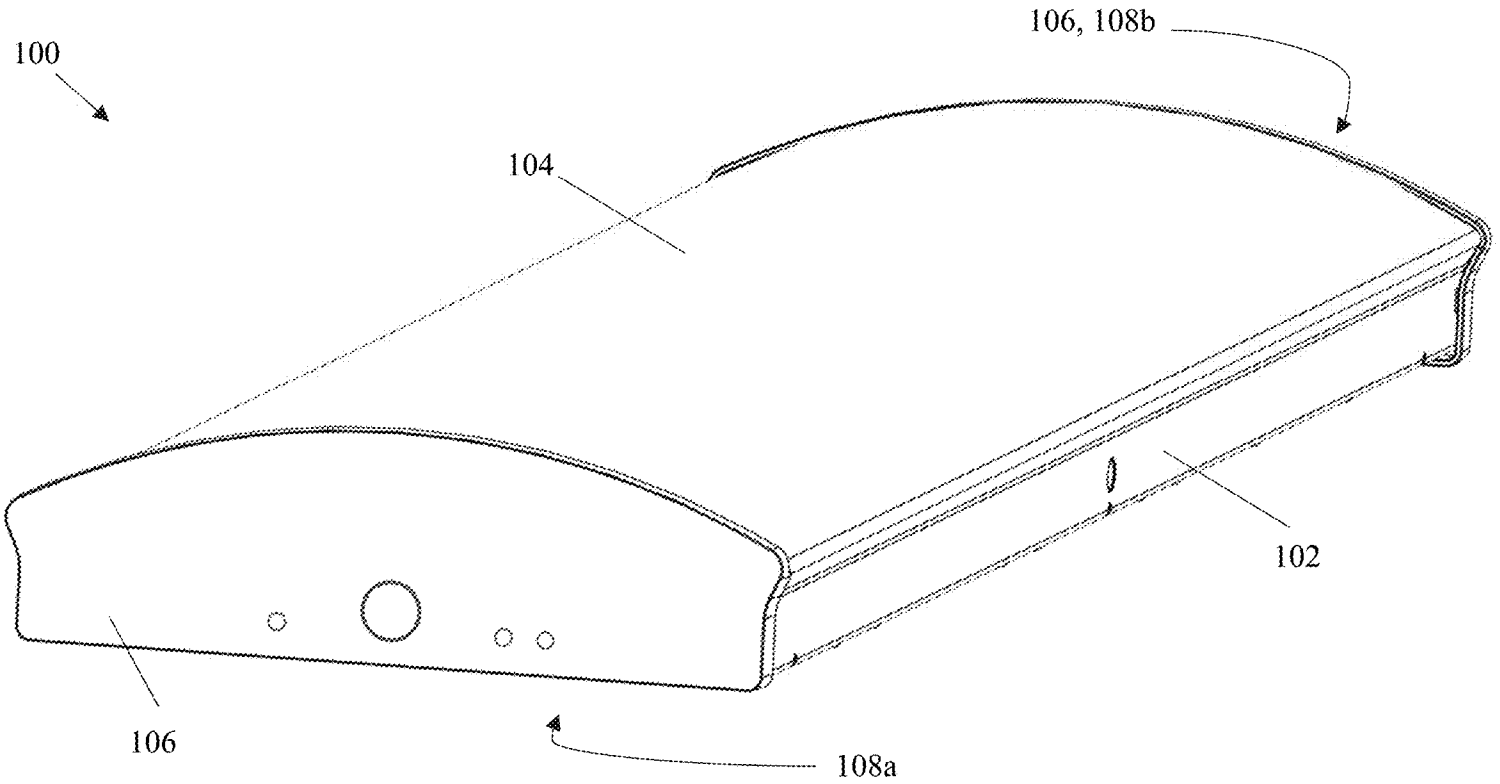
FIG. 1 illustrates a perspective view of an example luminaire comprising an example wire cover, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes a luminaire with a releasably lockable wire cover. The luminaire and the wire cover of the present disclosure are configured to be releasably locked to each other such that they remain locked during shipment and handling. That is, the luminaire and the wire cover are configured such that once the wire cover is releasably locked to the luminaire, the wire cover does not decouple from the luminaire till a user releases the locked wire cover from the luminaire. So, a wire cover of the present disclosure that is releasably locked to the luminaire does not decouple from the luminaire due to vibrations or the other impacts on the luminaire during shipping (e.g., from factory to field) and handling thereof. Further, the luminaire and the wire cover are configured for toolless coupling and decoupling, thereby eliminating any need for tools to lock and hold the wire cover to the luminaire and/or to decouple the wire cover from the luminaire. Furthermore, the luminaire and the wire cover are configured such that the coupling of the wire cover with the luminaire creates an electrical grounding path for the luminaire and/or the electronic components that are disposed in an electronics enclosure defined by the wire cover.

In one example, the luminaire includes a back plate that has a first tab that defines a tab receiving cavity. The first tab includes a first mating feature. Further, the luminaire includes a wire cover that has a second tab that is configured to be disposed in the tab receiving cavity of the back plate. The second tab of the wire cover includes a second mating feature. The first mating feature and the second mating feature may be complementary to each other.

The wire cover is coupled to the back plate by inserting the second tab of the wire cover into the tab receiving cavity defined by the first tab of the back plate. That is, the wire cover may be coupled to (and decoupled from) the back plate of the luminaire without using any tools. As the second tab of the wire cover is disposed in the tab receiving cavity of the back plate, a second mating feature of the second tab of the wire cover engages with the first mating feature of the first tab of the back plate to releasably lock the wire cover to the back plate of the luminaire. To decouple the wire cover from the back plate, the second mating feature of the wire cover must be released from the first mating feature of the back plate. In said example, as the second mating feature engages the first mating feature, an audible sound may be created to confirm and to ensure an end user that the two parts, i.e., the wire cover and the back plate are properly attached. Further, in some examples, when the second mating feature engages the first mating feature, an electrical grounding path may be created through the contact between the first and second mating features.

Example embodiments of the luminaire with the releasably lockable wire cover will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the luminaire with the releasably lockable wire cover may be embodied in many different forms and should not be construed as being limited to the embodiments set forth herein; rather, these embodiments are provided so that this disclosure will be thorough and complete, and will fully convey the scope of the technology to those appropriately skilled in the art. Even though the present disclosure may describe the releasably lockable wire cover as being used with linear luminaires, one of skill in the art can understand and appreciate that in other example embodiments, the releasably lockable wire cover may be used with any appropriate type of luminaires that house electronic components or electrical conductors (e.g., electrical wires) therein. The releasably lockable wire cover may be configured to replace any appropriate wire cover or electronics housing in any appropriate luminaire where the wire cover is coupled to the luminaire, provided complementary locking features are available in the luminaire.

The luminaire with the releasably lockable wire cover (or components thereof) described herein can be made of one or more of a number of suitable materials to allow the luminaire, the wire cover, and/or other associated components thereof to meet certain standards, tests (e.g., shipping and handling tests), cost requirements, and/or regulations while also maintaining durability in view of the one or more conditions under which the luminaire, the wire cover, and/or other associated components thereof can be exposed. Examples of such materials can include, but are not limited to, plastic, fiberglass, aluminum, etc.

Further, components of the luminaire with the releasably lockable wire cover (or portions thereof) described herein can be made from a single piece. In addition, or in the alternative, components of the luminaire with the releasably lockable wire cover (or portions thereof) can be made from multiple pieces that are coupled to each other. In such a case, the multiple pieces can be coupled to each other using one or more of a number of coupling methods, including but not limited to adhesives, compression fittings, mating threads, and slotted fittings, etc. One or more pieces that are coupled to each other can be coupled to each other in one or more of a number of ways, including but not limited to fixedly, hingedly, removeably, slidably, and threadably.

Terms such as "first", "second", "third", "top", "bottom", "side", "end", and "within" are used merely to distinguish one component (or part of a component or state of a component) from another. Such terms are not meant to denote a preference or a particular orientation, and are not meant to limit embodiments of the luminaire. In the following detailed description of the example embodiments, numerous specific details are set forth in order to provide a more thorough understanding of the present disclosure. However, it will be apparent to one of ordinary skill in the art that the luminaire with the releasably lockable wire cover of the present disclosure may be practiced without these specific details. In other instances, well-known features have not been described in detail to avoid unnecessarily complicating the description.

Turning now to the figures, example embodiments of an example luminaire with an example releasably lockable wire cover (hereinafter 'wire cover') will be described in connection with FIGS. 1-8. Referring to FIGS. 1-8, an example luminaire 100 includes a back plate 102, a lens 104 that is coupled to the back plate 102, and end caps 106 that are disposed on opposite ends (108*a*, 108*b*) of the luminaire 100 and coupled to the back plate 102 and the lens 104. The end caps 106 may be configured to cover the ends (e.g., laterals ends 108*a*, 108*b*) of the luminaire 100 and support and securely retain a portion of the lens 104 (e.g., edges) therein.

The back plate 102, the lens 104, and the end caps 106 are coupled to each other and arranged such that they define a luminaire internal cavity 202 (shown in FIG. 2) that is configured to house a light engine of the luminaire therein. The light engine may include one or more light source assemblies 220 (shown in FIG. 6) and/or electronic components associated with the luminaire 100 that are configured to supply power to the light source assemblies 220.

Figure 2:
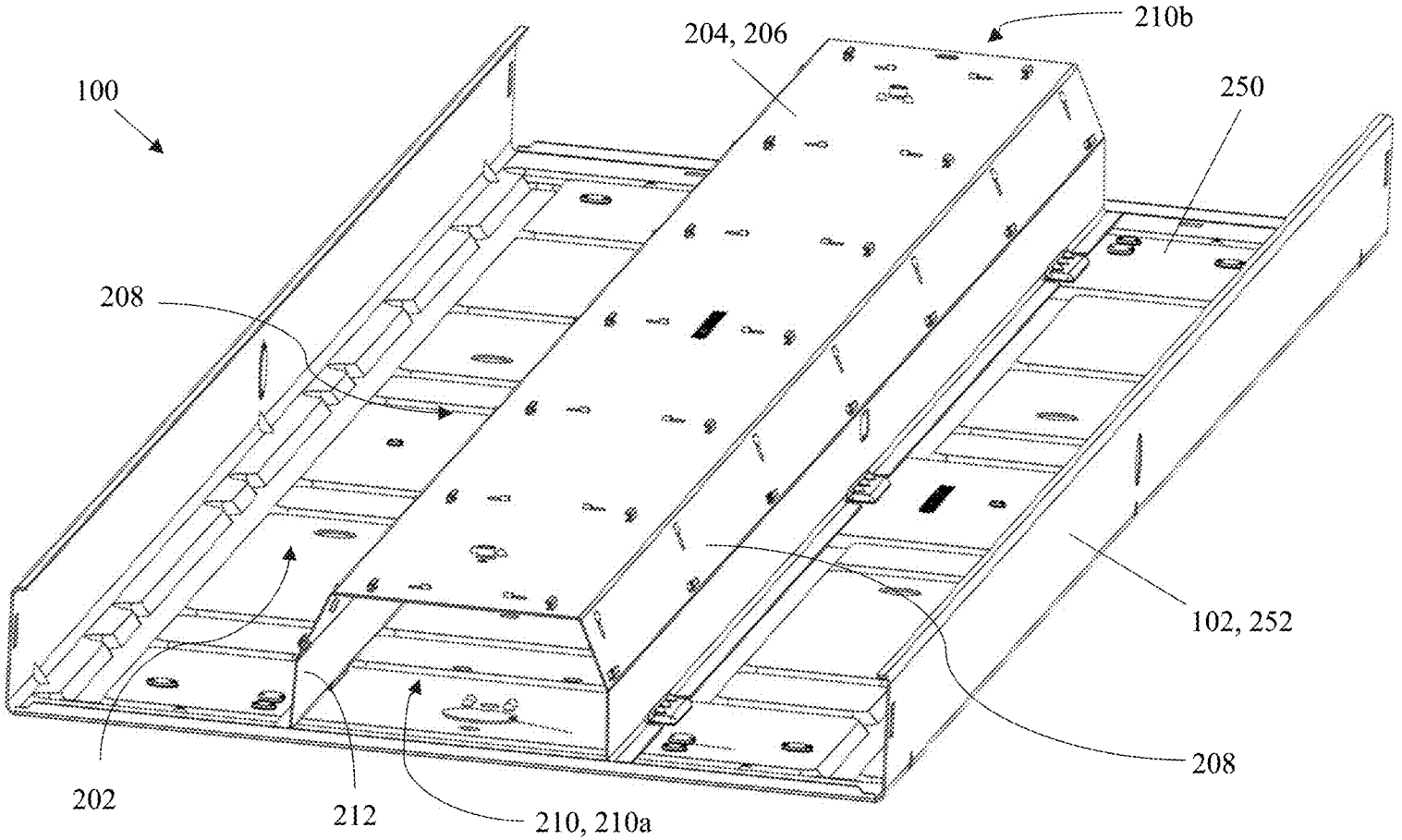
FIG. 2 illustrates a perspective view of the example luminaire of FIG. 1 with the lens and the end caps of the luminaire removed to illustrate the example wire cover that is coupled to an example backplate of the example luminaire, in accordance with example embodiments of the present disclosure.
Figure 3:
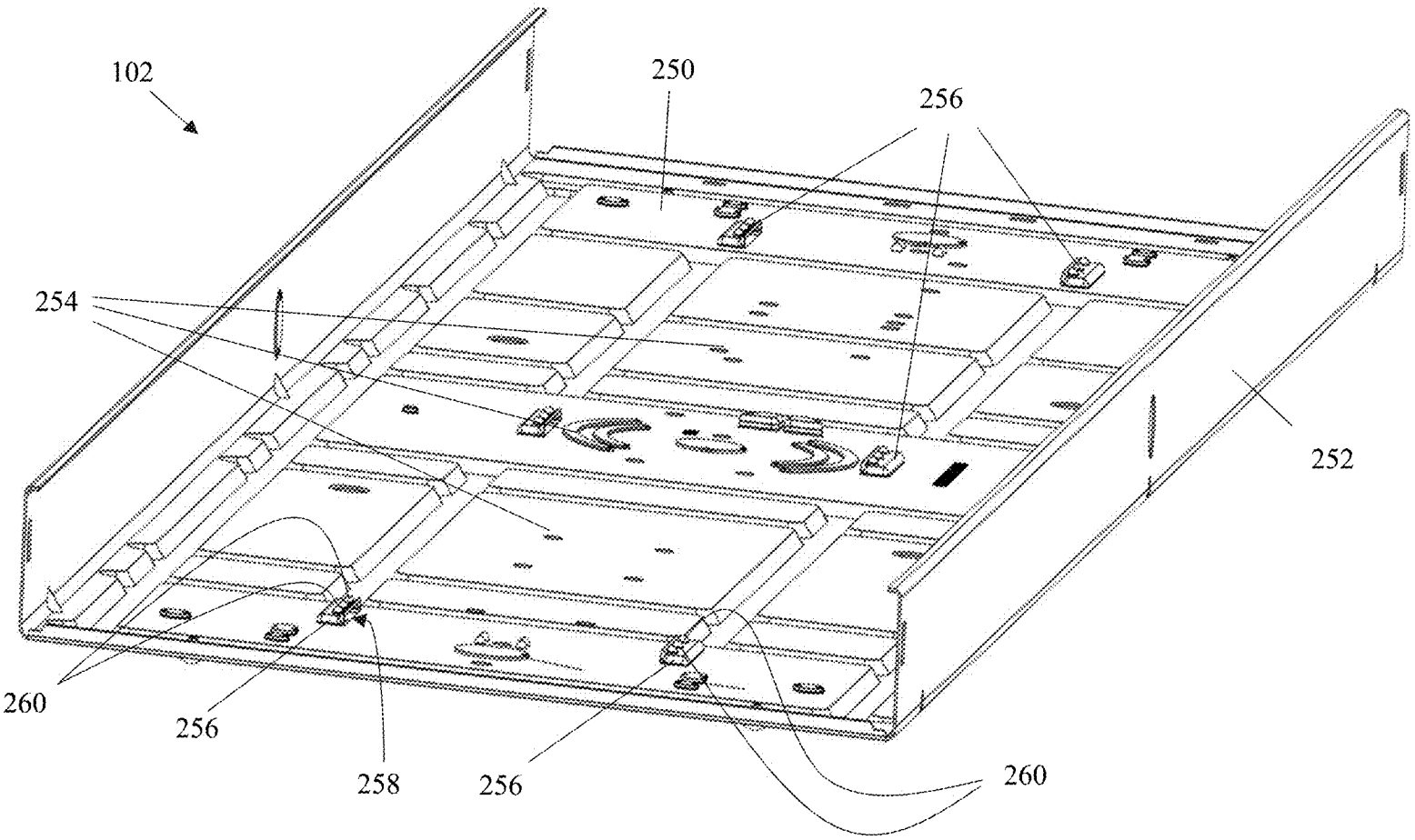
FIG. 3 illustrates a perspective view of the example backplate of the luminaire of FIG. 1, in accordance with example embodiments of the present disclosure.

As illustrated in FIGS. 2 and 3, the back plate 102 may include a base 250 and sidewalls 252 that extend substantially perpendicularly from at least a portion of a perimeter of the base 250. The base 250 may include one or more mounting apertures 254 that are configured to receive mounting features therethrough to mount the luminaire 100 to an appropriate mounting surface (e.g., ceiling, wall, etc.). Further, the base 250 may include one or more locking tabs 256, where each locking tab 256 defines a tab receiving cavity 258. The locking tabs 256 of the back plate 102 may be stamped into or formed from a portion of the base 250 of the back plate 102 such that the locking tabs 256 project out from the base 250 of the back plate 102 to define the tab receiving cavity 258. Each locking tab 256 may include one or more mating features 260 that are formed therein.

In addition to the back plate 102, the lens 104, and the end caps 106; the luminaire 100 may include a wire cover 204 (shown in FIG. 2) that is disposed in the luminaire internal cavity 202 and removably coupled to the back plate 102 of the luminaire 100. As illustrated in FIGS. 2-8, the example wire cover 204 may include a base wall 206 and sidewalls 208 that extend angularly or substantially perpendicular to the base wall from at least a portion of the perimeter of the base wall 206. The inner surface 212 of the base wall 206 and the sidewalls 208 may define an electronics cavity 210 that is open at the lateral ends (210*a*, 210*b*) thereof and at the side that is opposite to the base wall 206. The back plate 102 and the end caps 106 may enclose the electronics cavity 210. That is, the back plate 102 may cover the open side of the wire cover 204 that is opposite to the base wall 206 when the wire cover 204 is coupled to the back plate 102 and the end caps 106 may cover the open lateral ends (210*a*, 210*b*) of the wire cover 204 when the end caps 106 are coupled to the back plate 104. The electronics cavity 210 that is defined by the wire cover 204 may be configured to house and conceal one or more electronic components and/or electrical conductors (e.g., electrical wires) associated with the luminaire 100 therein. Example electronic components may include, but are not limited to, a driver, a ballast, etc.

Figure 4:
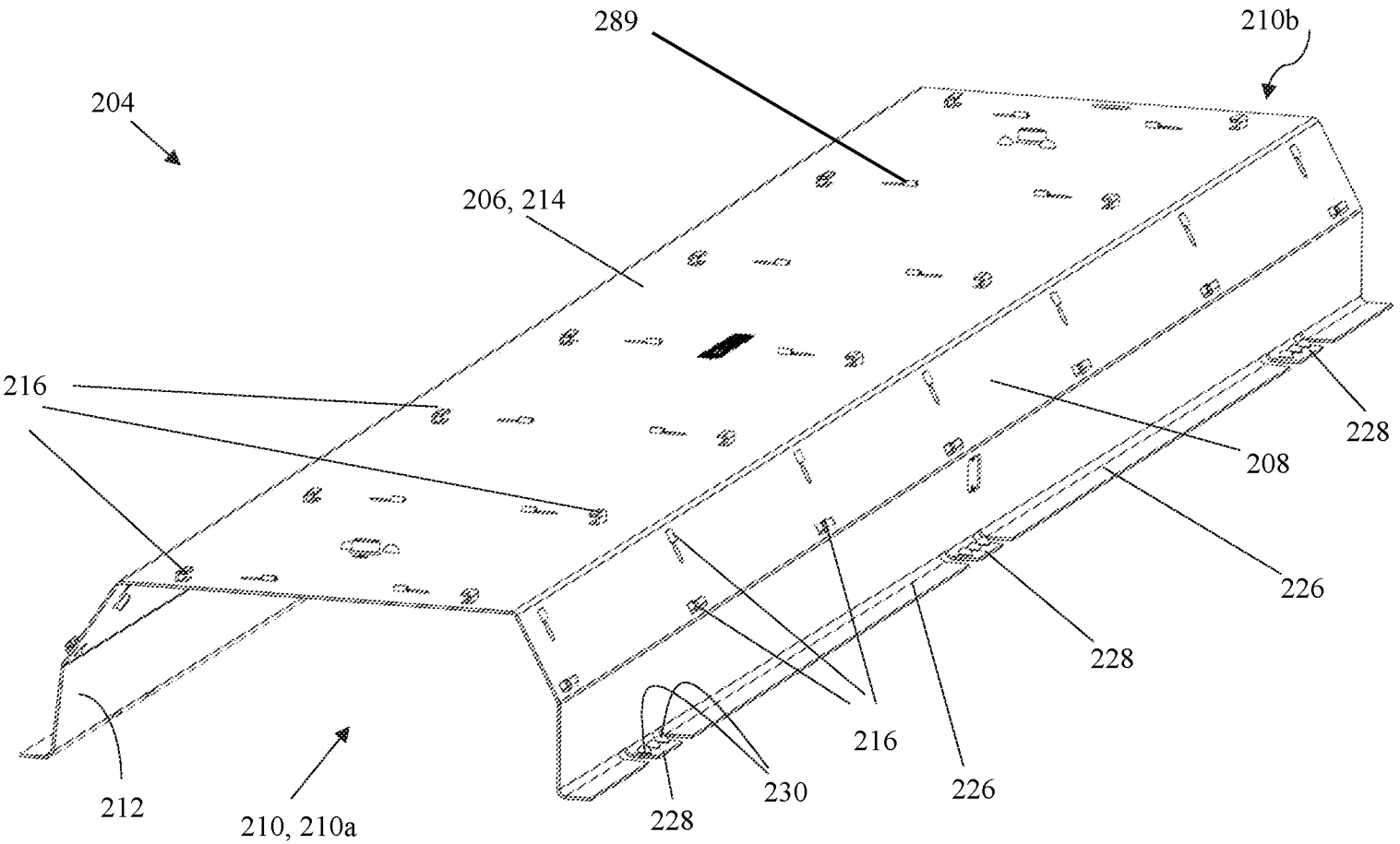
FIG. 4 illustrates a perspective view of the example wire cover of the luminaire of FIG. 1, in accordance with example embodiments of the present disclosure.
Figure 5:
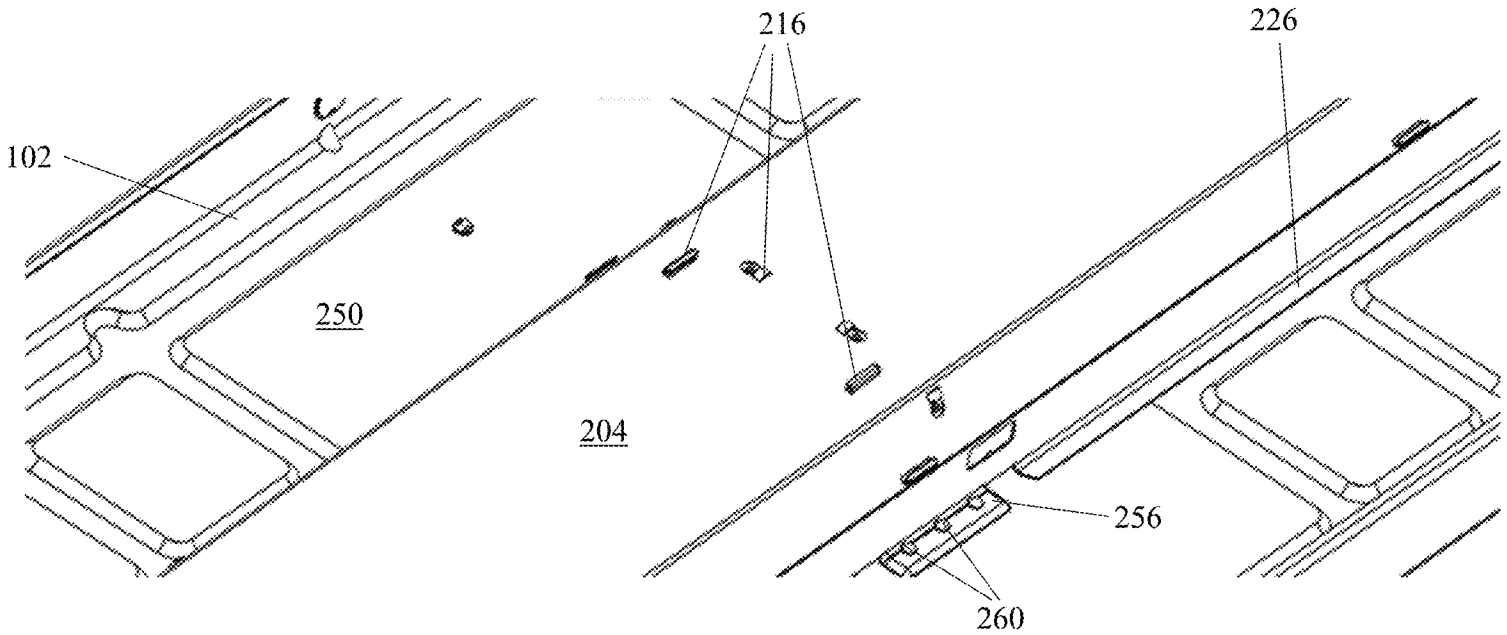
FIG. 5 illustrates an enlarged view of a portion of the example luminaire of FIG. 1 that exemplifies a coupling of the wire cover with the back plate, in accordance with example embodiments of the present disclosure.
Figure 6:
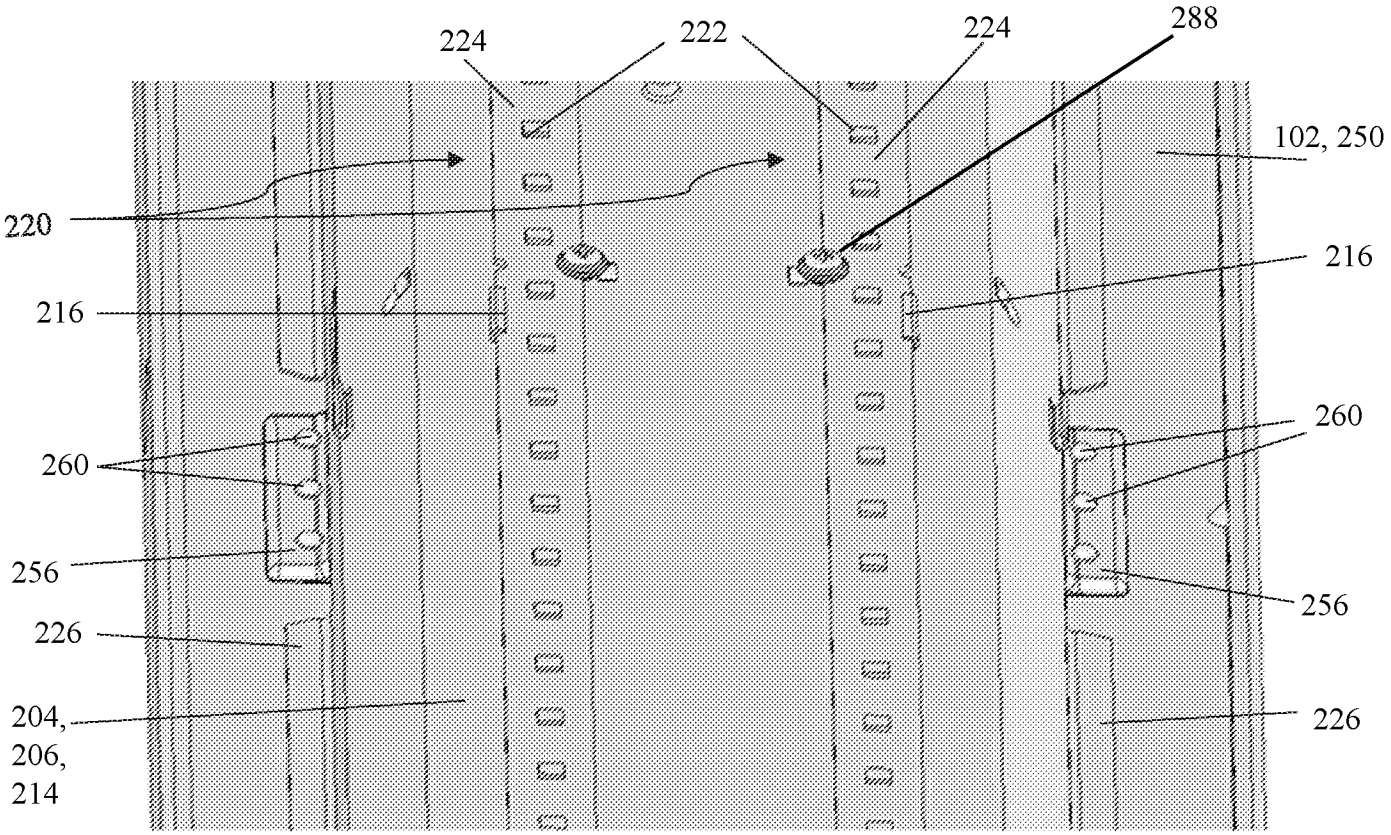
FIG. 6 illustrates another enlarged view of a portion of an example luminaire that shows light sources coupled to and disposed on the example wire cover, in accordance with example embodiments of the present disclosure.

Further, the wire cover 204 may include coupling tabs 216 that are disposed on an outer surface 214 of the base wall 206 and/or the sidewalk 206 thereof. The coupling tabs 216 may be configured to securely couple and retain a light source assembly 220 on the wire cover 204 as illustrated in FIG. 6. In some cases, one or more fastening devices 288 (e.g., screws) can be used, in addition to the coupling tabs 216, to help secure a light source assembly 220 to the wire cover 204. In such cases, each fastening device 288 can be inserted into a coupling feature 289 (in this case, an aperture), as shown in FIG. 4, in the base wall 206 of the wire cover 204. In the example embodiment illustrated in FIG. 6, the light source assembly 220 may include an array of light emitting diodes (LEDs) 222 disposed on a substrate 224 such as a printed circuit board, for example. However, in other example embodiments, the light source assembly 220 may include any other appropriate light source, such as fluorescent lamps, halogen lamps, other point light sources, printed LEDs, etc., without departing from a broader scope of the present disclosure.

In other words, the wire cover 204 may be configured such that an inner surface 212 thereof defines an electronics cavity that is configured to house electronics components and/or electrical conductors therein, while the outer surface 214 thereof may define a light source attachment surface that is configured to securely retain one or more light source assemblies 220 thereon.

Additionally, the wire cover 204 may include flange sections 226 that extend outward from the outer edge of the sidewalls 208. The flange sections 226 may operate as the feet of the wire cover 204 that rest on the back plate 102 when the wire cover 204 is coupled to the back plate 102. Further, the wire cover 204 may include one or more cover tabs 228 that are disposed in between the flange sections 226. In some example embodiments, the cover tabs 228 may be defined by the flange sections 226. In other example embodiments, the cover tabs 228 may be separate from the flange sections 226 and may not be defined by the flange sections. Further, in some example embodiments, the wire cover 204 may not include the flange 226. Instead, in said example embodiments, the wire cover 204 may only include the cover tabs 228. Each cover tab 228 may include one or more mating features 230.

In one example, the mating features 230 of the cover tab 228 may be complementary to the mating features 260 of the locking tabs 256 of the back plate 102. In one example embodiment, as illustrated in FIGS. 2-8, the mating features 230 of the cover tabs 228 and the mating features 260 of the locking tabs 256 may include dimples that are substantially hemispherical in shape. That is, each mating feature (230, 260) of the cover tab 228 and the locking tab 256 may have a substantially convex outer surface and a substantially concave inner surface. In another example embodiment, the mating features (230, 260) may be dimples having any other appropriate shape without departing from a broader scope of the present disclosure. For example, the mating features (230, 260) may have a triangular or pyramid shape or any other appropriate shape where the surfaces meet at an apex. In yet another example embodiment, the mating features (230, 260) may include a slot and snap fit hook feature, where one mating feature is the slot and the other mating feature is the snap fit hook.

It is noted that the above-mentioned examples of mating features (230, 260) are non-limiting, and the mating features (230, 260) of the wire cover 204 and the back plate 102 of the luminaire 100 can include any appropriate complementary mating features that allow the wire cover 204 to be releasably locked to the back plate 102 without using any tools, e.g., by engaging the mating features 230 of the wire cover 204 with the mating features 260 of the back plate 102.

Figure 7:
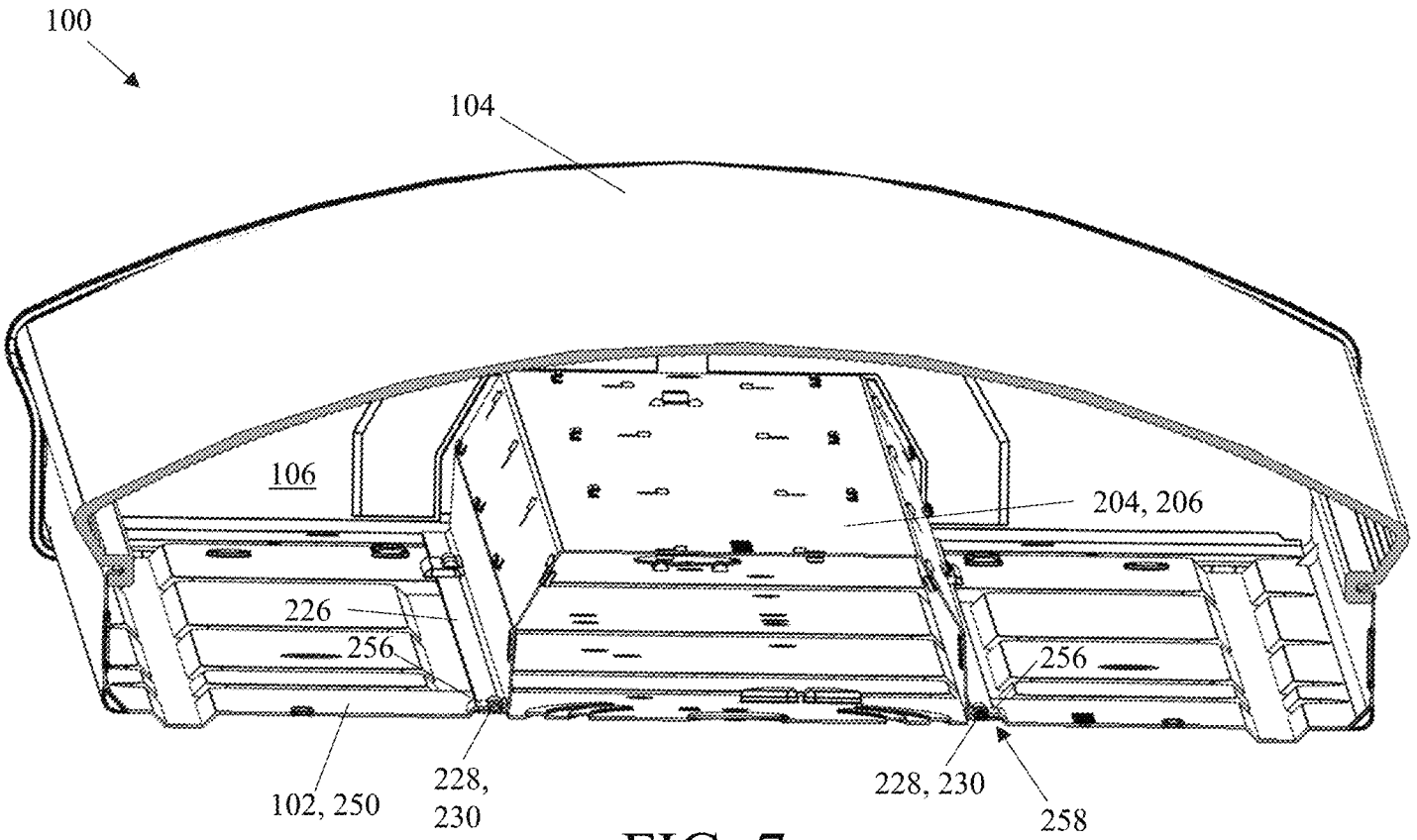
FIG. 7 illustrates a cross-section view of the example luminaire of FIG. 1, in accordance with example embodiments of the present disclosure.
Figure 8:
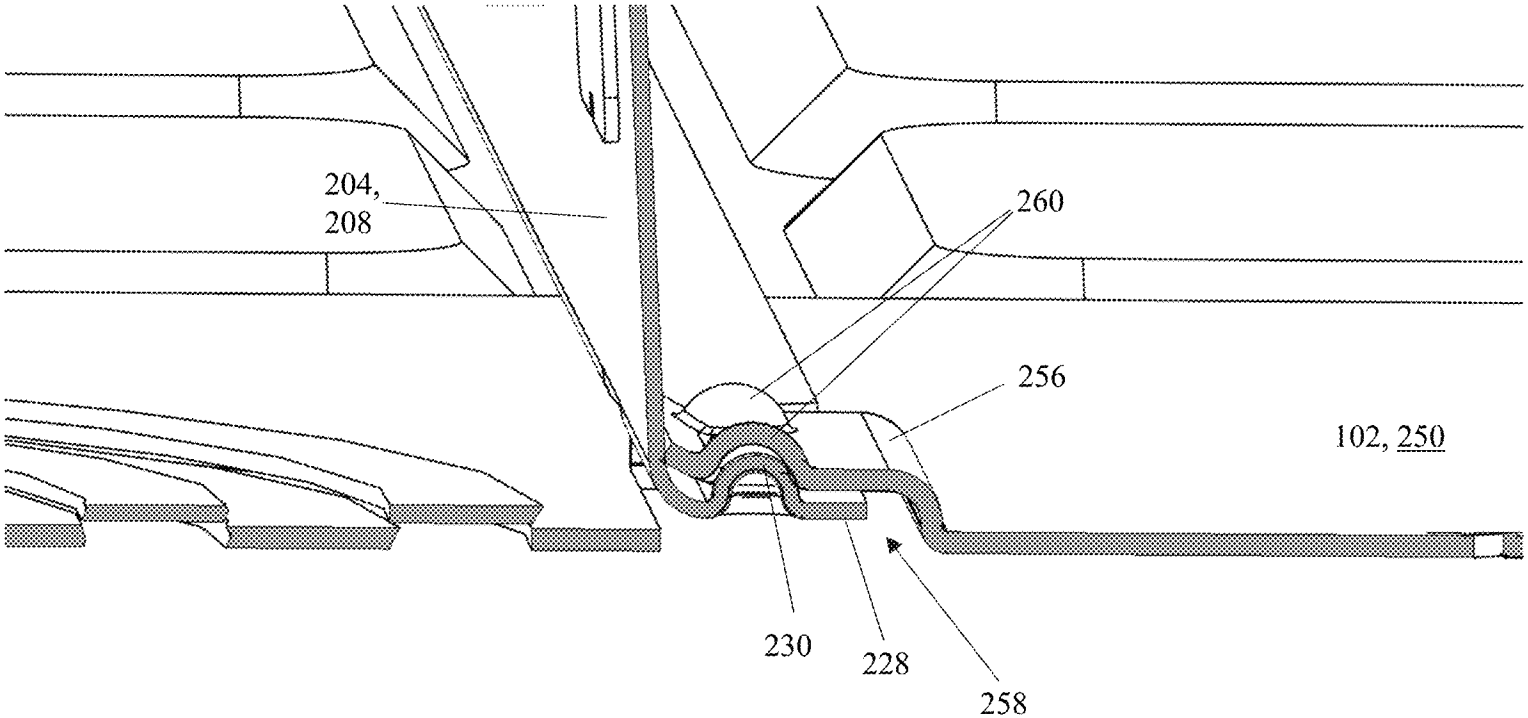
FIG. 8 illustrates an enlarged cross-section view of a portion of the example luminaire of FIG. 1 that exemplifies an engagement of a mating feature of the example wire cover with a mating feature of the example back plate to releasably lock the example wire cover to the example back plate of the example luminaire, in accordance with example embodiments of the present disclosure.

As illustrated in FIGS. 7-8, the wire cover 204 may be disposed in the luminaire internal cavity 202 and coupled to the back plate 102 of the luminaire 100 by inserting the cover tabs 228 of the wire cover 204 into the respective tab receiving cavities 258 defined by the locking tabs 256 of the back plate 102 till the mating features 230 of the cover tabs 228 engage the respective mating features 260 of the locking tabs 256. When the mating features 230 of the cover tabs 228 of the wire cover 204 engage the respective mating features 260 of the locking tabs 256 of the back plate 102, the wire cover 204 may be releasably locked to the back plate 102 of the luminaire. Further, when the mating features 230 of the cover tabs 228 of the wire cover 204 engage the respective mating features 260 of the locking tabs 256 of the back plate 102, the outer surface of the mating features 230 of the cover tabs 228 may contact the inner surface of the mating features 260 of the locking tabs 256 as illustrated in FIG. 8. In some example embodiments, the contact between the outer surface of the mating features 230 of the cover tabs 228 with the inner surface of the mating features 260 of the locking tabs 256 may create an electrical grounding path for the luminaire 100 (e.g., the electronic components disposed in the luminaire 100). For example, in an example embodiment where the mating features (230, 260) are shaped substantially like a pyramid, the apex of the mating feature 230 of the cover tabs 228 may cut into the paint and engage the conductive inner surface of the mating features 260 of the locking tabs 256 to form the electrical grounding path.

To decouple the wire cover 204 from the back plate 102, the mating features 230 of the cover tabs 228 of the wire cover 204 must be disengaged from the respective mating features 260 of the locking tabs 256 of the back plate 102. In one or more example embodiments, the mating features 230 of the cover tabs 228 may be disengaged from the respective mating features 260 of the locking tabs 256 by applying an appropriate force on the wire cover 204 and/or the back plate 102, e.g., by a user.

Furthermore, in some example embodiments, when the mating features 230 of the cover tabs 228 of the wire cover 204 engage the respective mating features 260 of the locking tabs 256 of the back plate 102, an audible sound or cue may be generated to confirm or to ensure a user that the wire cover 204 has been releasably locked to the back plate 102 of the luminaire. In one example, the audible sound or cue may be a click sound. However, in other examples, the audible sound or cue may include any other appropriate sound without departing from a broader scope of the present disclosure.

Even though FIGS. 1-8 illustrate a linear luminaire 100 with a back plate 102 and a wire cover 204 that are substantially rectangular in shape, one of skill in the art can understand and appreciate that in other example embodiments of the present disclosure, any other appropriate luminaire having a back plate and a wire cover of any other appropriate shape may be used without departing from a broader scope of the present disclosure. Also, even though the present disclosure describes that the wire cover 204 is coupled to the back plate 102 of the luminaire 100, one of skill in the art can understand and appreciate that in other example embodiments, the wire cover may be coupled to any other appropriate portion of the luminaire, for example a housing of the luminaire, without departing from a broader scope of the present disclosure provided that the other appropriate portion of the luminaire includes tabs that define tab receiving openings and comprise mating features that are complementary to the mating features of the wire cover.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A luminaire comprising:

a back plate having a first tab that defines a first tab receiving cavity and a second tab that defines a second tab receiving cavity, the first tab comprising a first mating feature formed therein, the second tab comprising a second mating feature formed therein;

a cover that is configured to securely house an electronic component within the luminaire, the cover comprising a third tab having a third mating feature formed therein and a fourth tab having a fourth mating feature formed therein, wherein the third mating feature is disposed on a first side wall of the cover, wherein the fourth mating feature is disposed on a second side wall of the cover, wherein the first side wall is opposite the second side wall; and a light source assembly coupled to a flexible base wall of the cover, wherein the third mating feature is complementary to the first mating feature, wherein the fourth mating feature is complementary to the second mating feature, wherein the cover is coupled to the back plate by disposing the third tab of the cover in the first tab receiving cavity defined by the first tab of the back plate such that the third mating feature engages the first mating feature and by also disposing the fourth tab of the cover in the second tab receiving cavity defined by the second tag of the back plate such that the fourth mating feature engages the second mating feature to releasably lock the cover to the back plate, and wherein the first side wall and the second side wall of the cover are disposed on either side of the flexible base wall, wherein a compressive force is simultaneously applied to the first side wall and the second side wall to reduce a distance between the third tab and the fourth tab by bending the flexible base wall from a default position to a flexed position, and wherein subsequently the compressive force is removed to return the flexible base wall to the default position, thereby allowing the third mating feature to engage the first mating feature and the fourth mating feature to engage the second mating feature.

2. The luminaire of claim 1, wherein the flexible base wall of the cover comprises coupling tabs that are configured to securely retain the light source assembly on an outer surface of the flexible base wall of the cover.

3. The luminaire of claim 2, wherein the flexible base wall of the cover further comprises at least one coupling feature used to help securely retain at least one substrate of the light source assembly.

4. The luminaire of claim 3, wherein the at least one coupling feature is configured to receive at least one fastening device, wherein the at least one fastening device, when engaged with the at least one coupling feature, abuts against the at least one substrate.

5. The luminaire of claim 2, wherein the light source assembly comprises light emitting diodes (LEDs).

6. The luminaire of claim 1, wherein the first mating feature and the third mating feature are configured such that an engagement of the first mating feature and the third mating feature generates an audible cue to confirm the engagement of the first mating feature with the third mating feature.

7. The luminaire of claim 6, wherein the audible cue is a click sound.

8. The luminaire of claim 1, wherein the first mating feature and the third mating feature are dimples that are substantially hemispherical in shape.

9. The luminaire of claim 1, wherein the first mating feature and the third mating feature are dimples that are substantially pyramid shaped.

10. The luminaire of claim 1:

wherein when the third mating feature engages the first mating feature, a portion of a surface of the third mating feature contacts a portion of another surface of the first mating feature such that the contact creates an electrical grounding path for the electronic component.

11. The luminaire of claim 1, wherein the first mating feature is a female mating feature and the third mating feature is a male mating feature.

12. The luminaire of claim 1, wherein the first mating feature is a male mating feature and the third mating feature is a female mating feature.

13. The luminaire of claim 1, wherein the cover defines an electronics enclosure that is configured to house the electronic component therein.

14. The luminaire of claim 1:

wherein when the third mating feature engages the first mating feature, a portion of a surface of the third mating feature contacts a portion of another surface of the first mating feature to create an electrical grounding path for the light source assembly.

15. The luminaire of claim 1, wherein the light source assembly comprises a first substrate and a second substrate, wherein the first substrate is positioned parallel and proximate to the first side wall, wherein the second substrate is positioned parallel and proximate to the second side wall, wherein the first substrate and the second substrate have a gap therebetween, and wherein the flexible base wall of the cover flexes in the gap.

16. A wire cover of a luminaire, the wire cover comprising:

a first side wall comprising a first tab having a first mating feature formed therein;

a second side wall comprising a second tab having a second mating feature formed therein; and a flexible base wall disposed between the first side wall and the second side wall, wherein the flexible base wall comprises a plurality of substrate coupling tabs disposed on an outer surface of the flexible base wall, wherein the plurality of substrate coupling tabs are configured to receive at least one substrate of a light source assembly, wherein the at least one substrate has at least one light source disposed thereon, wherein the flexible base wall flexes from a default position to a flexed position when a compressive force is simultaneously applied to the first side wall and the second side wall to reduce a distance between the first tab and the second tab, wherein the first mating feature is configured to engage a third mating feature of a third tab formed in a back plate of the luminaire to releasably lock the wire cover to the back plate of the luminaire, the first mating feature being complementary to the third mating feature, wherein the second mating feature is configured to engage a fourth mating feature of a fourth tab formed in the back plate of the luminaire to further releasably lock the wire cover to the back plate of the luminaire, the second mating feature being complementary to the fourth mating feature, and wherein subsequently the compressive force is removed to return the flexible base wall to the default position, thereby allowing the first mating feature to engage the third mating feature and the second mating feature to engage the fourth mating feature.

17. The wire cover of claim 16, wherein the third tab of the luminaire defines a tab receiving cavity that is configured to receive the first tab of the wire cover therein to couple the wire cover to the luminaire.

18. The wire cover of claim 16, wherein the compressive force is simultaneously applied to the first side wall and the second side wall without use of tools.

* * * * *